US005454462A

United States Patent [19]

Chang

[11] Patent Number: 5,454,462

[45] Date of Patent: Oct. 3, 1995

[54] STRUCTURE OF PAPER MONEY RECOGNITION AND TRANSMISSION SYSTEM

[75] Inventor: Yuan F. Chang, Taipei, Taiwan

[73] Assignee: Gamemax Corporation, Taipei, Taiwan

[21] Appl. No.: 328,448

[22] Filed: Oct. 25, 1994

Related U.S. Application Data

[63] Continuation-in-part of Ser. No. 294,365, Aug. 23, 1994.

[51] Int. Cl.[6] ..... G07F 7/04

[52] U.S. Cl. ..... 194/203; 194/206

[58] Field of Search ..... 194/202, 203, 194/205, 206, 207, 344

[56] References Cited

U.S. PATENT DOCUMENTS

| | | | |
|---|---|---|---|
| 3,180,491 | 4/1965 | Danko | 194/207 |
| 4,884,671 | 12/1989 | Gardellini | 194/207 |
| 4,958,715 | 9/1990 | Suris | 194/206 |
| 5,005,688 | 4/1991 | Yukimoto et al. | 194/206 |
| 5,113,990 | 5/1992 | Gabrius et al. | 194/206 |
| 5,236,339 | 8/1993 | Nishiumi et al. | 194/203 X |
| 5,259,490 | 11/1993 | Gardellini | 194/203 |
| 5,316,117 | 5/1994 | Griner et al. | 194/203 |
| 5,372,361 | 12/1994 | Isobe et al. | 194/203 X |

FOREIGN PATENT DOCUMENTS

| | | | |
|---|---|---|---|
| 3810095 | 7/1989 | Germany | 194/203 |
| 4062697 | 2/1992 | Japan | 194/207 |

*Primary Examiner*—William E. Terrell
*Assistant Examiner*—Scott L. Lowe
*Attorney, Agent, or Firm*—Browdy and Neimark

[57] ABSTRACT

A paper money recognition and transmission system including a housing with a paper money slot, an upper mainframe and a lower mainframe detachably connected together and mounted inside the housing, a transmission unit mounted on the lower mainframe and consisting of a step motor, a belt transmission mechanism, a gear transmission mechanism, a plurality of caps, and two rubber rollers, a paper money recognition circuit, the paper money recognition circuit including sensors controlled to detect and recognize inserted paper money and to turn the step motor forwards, when a true paper money is recognized, causing the inserted paper money to be delivered forwards, the step motor being turned reversely when a counterfeit paper money is detected, causing the counterfeit paper money to be delivered backwards out of the system, the lower mainframe having a convex portion matched with paper money transmission rubber rollers to prevent inserted paper money from being pulled backwards.

1 Claim, 10 Drawing Sheets

(B)

(C)

STRUCTURE OF PAPER MONEY RECOGNITION AND TRANSMISSION SYSTEM

CROSS-REFERENCE OF THE RELATED APPLICATION

This is a continuation-in-part of co-pending parent application Ser. No. 08/294,365, filed Aug. 23, 1994, entitled "Paper Money Recognition and Transmission System for Vending Machines".

BACKGROUND OF THE INVENTION

A variety of vending machines are known and intensively installed in different locations indoors as well as outdoors for selling different things. Conventional vending machines commonly accept coins only. There are also know certain vending machines which accept paper money. These vending machines which accept paper money simply comprises a paper money recognition mechanism and a paper money transmission mechanism. In order to prevent the inserted paper money from being obtained by stealing, hook means are commonly installed to prohibit the inserted paper money from being pulled out of the machine. However, this security installation may cause the received paper money to be damaged when thieves try to steal the money.

The paper money recognition and transmission system of the aforesaid co-pending parent application of the present invention was developed under the circumstances in view. This structure of paper money recognition and transmission system comprises a housing, an upper mainframe, a lower mainframe, a transmission unit, and a paper money recognition circuit. The transmission unit carries the inserted paper money forward when the inserted paper money is recognized. When a paper money is inserted into the vending machine, the front sensor of the paper money recognition circuit is triggered to send a signal to a step motor causing it to drive the transmission unit, and therefore the inserted paper money is carried through the upper mainframe and the lower mainframe into a money box. Before entering the money box, the rear sensor of the paper money recognition circuit-is turned on to recognize the inserted paper money. If the inserted paper money is a counterfeit paper money, the step motor will be turned in the reversed direction to send the counterfeit paper money back to the paper money slot. If the inserted paper money is recognized as true money, the paper money will be delivered to the money box.

SUMMARY OF THE INVENTION

The present invention is an improvement made on the paper money recognition and transmission system of the aforesaid co-pending parent application.

According to one aspect, a convex portion is made on the open chamber of the lower mainframe to match with the rubber rollers so that recognized paper money is prohibited from being pulled backwards when it is delivered to the rubber rollers.

According to another aspect of the present invention, the paper money recognition circuit comprises three light emitting diodes, which will be triggered to flash once and then turned off immediately after flashing when inserted paper money is recognized and delivered through the rubber rollers, and which will be turned on to give light constantly when inserted paper money is jammed.

DETAILED DESCRIPTION OF THE PREFERRED EMBODIMENT

Figure 1:
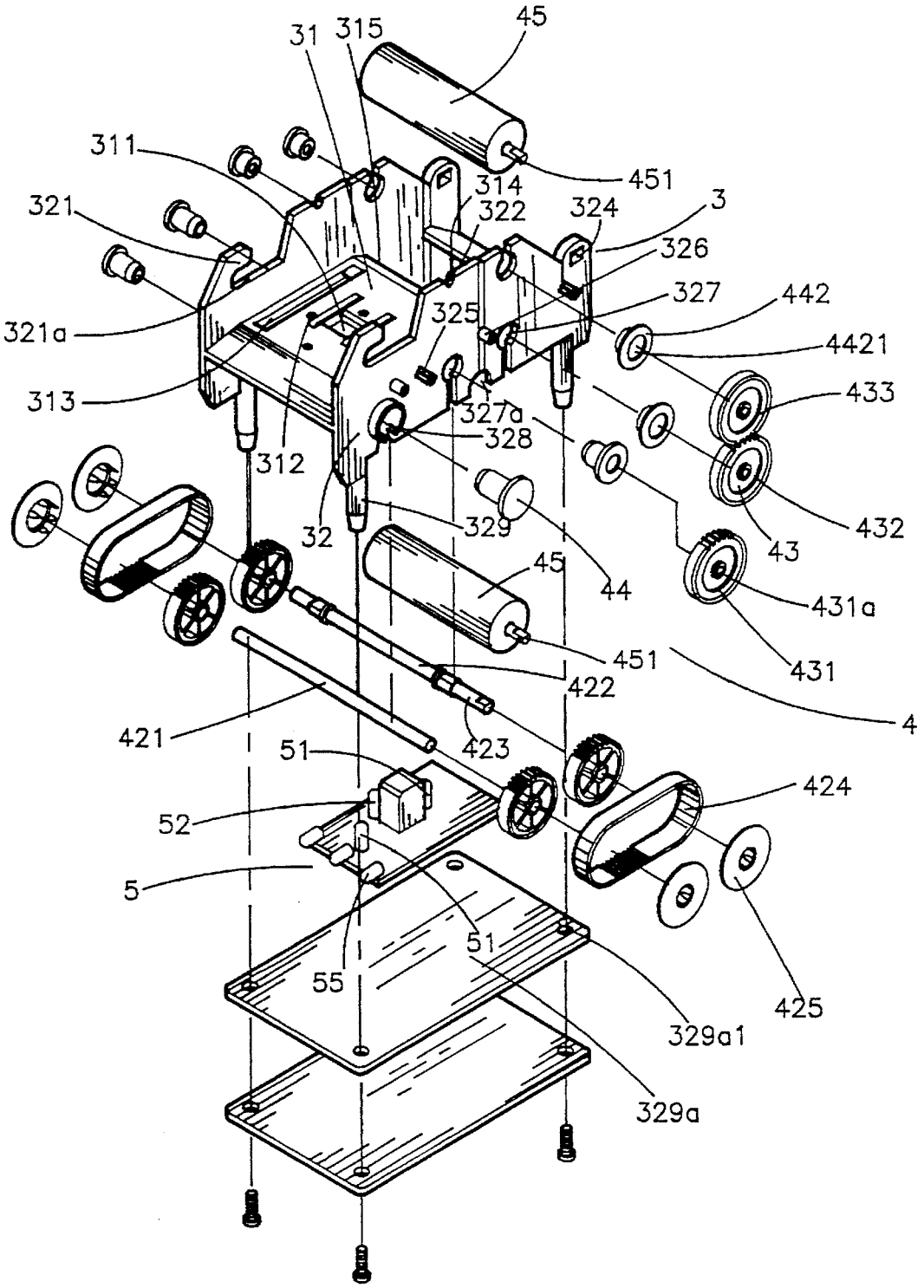
FIG. 1 is an exploded view of the lower mainframe, the transmission unit, and the paper money recognition circuit of the paper money recognition and transmission system of the co-pending parent application.
Figure 2:
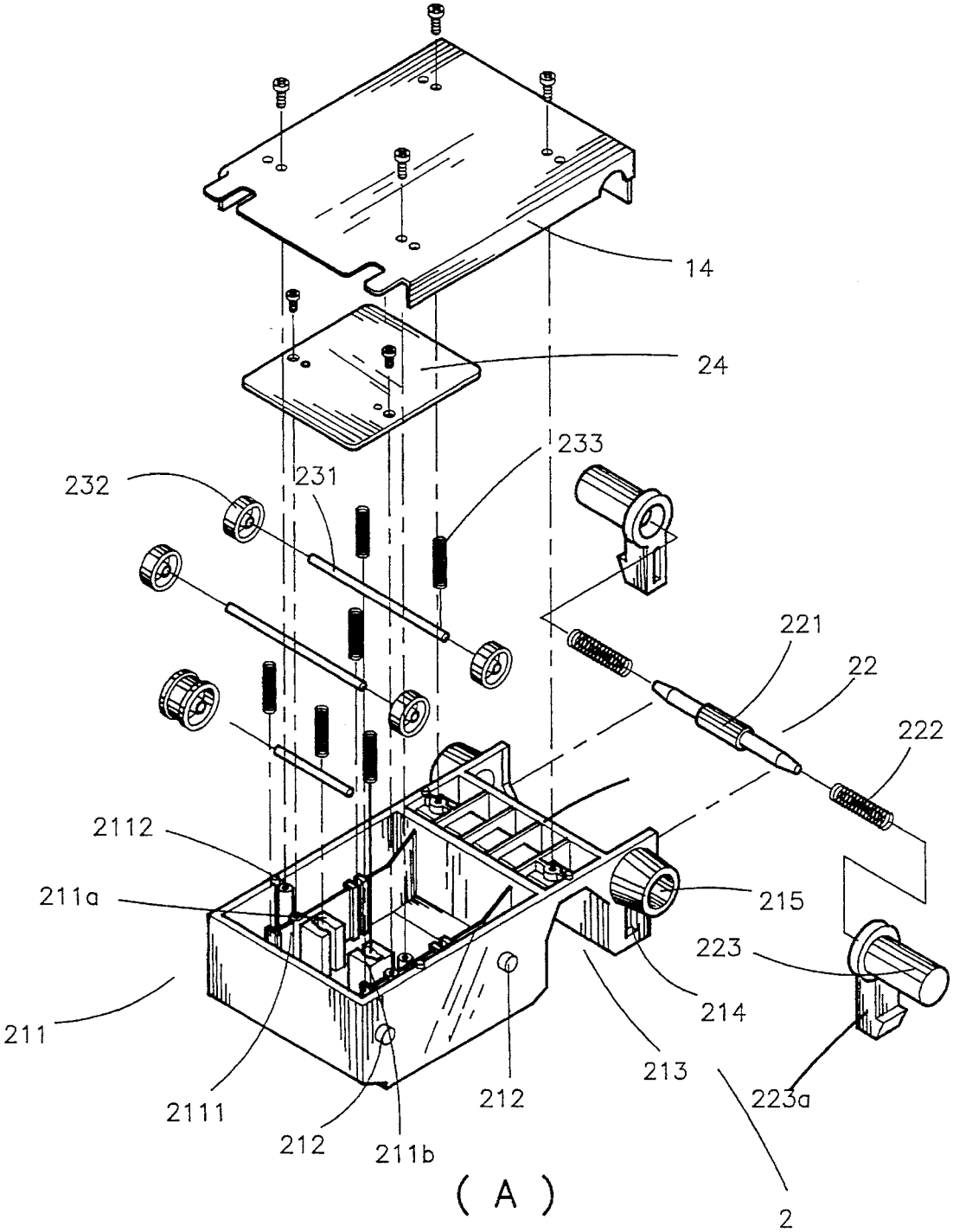
FIG. 2A is an exploded view of the upper mainframe of the paper money recognition and transmission system of the preferred embodiment of the present invention.
FIG. 2B is an exploded view of the lower mainframe, the transmission unit, and the paper money recognition circuit of the paper money recognition and transmission system of the preferred embodiment of the present invention.
FIG. 2C is an exploded view of the housing of the paper money recognition and transmission system of the preferred embodiment of the present invention.
Figure 2:
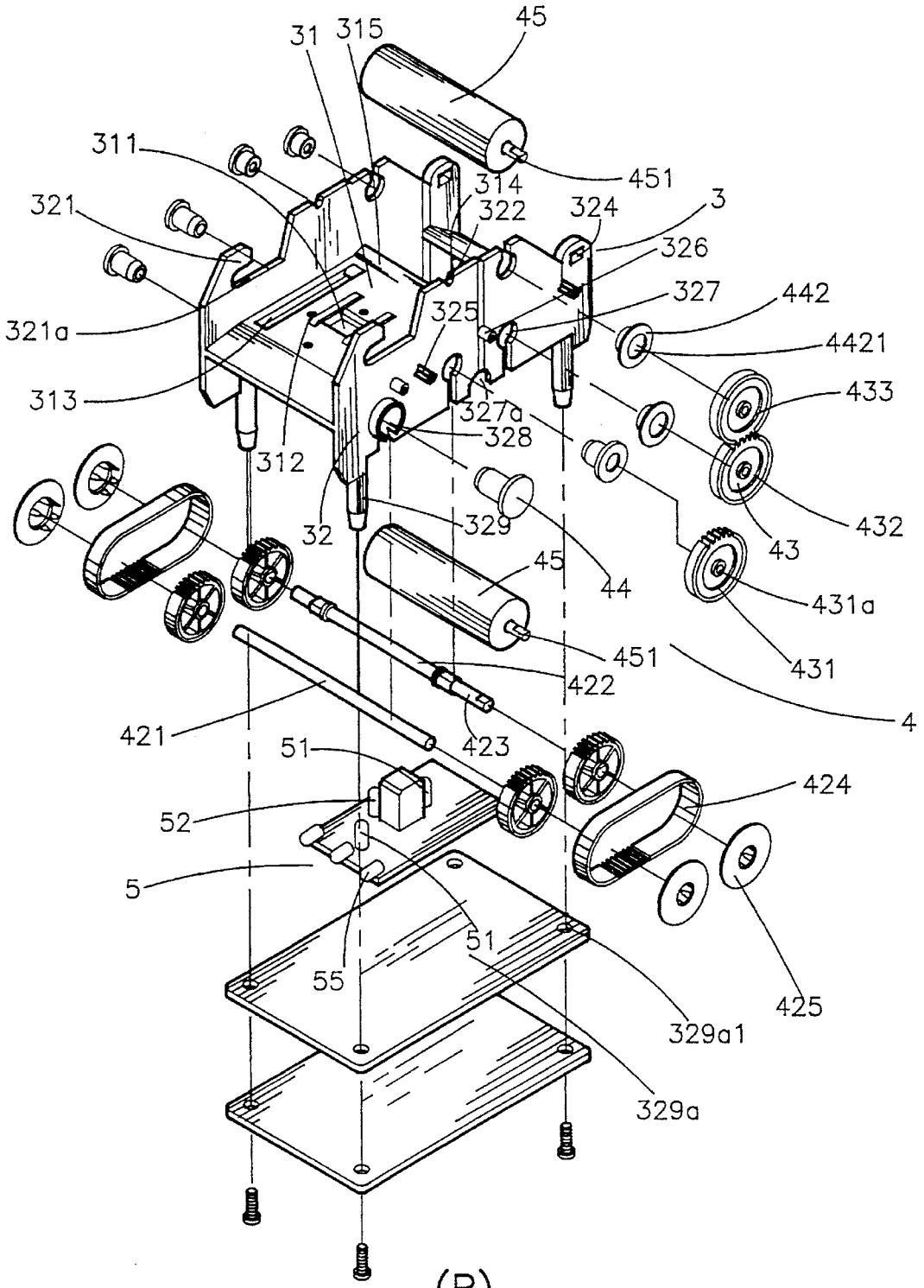
Figure 2:
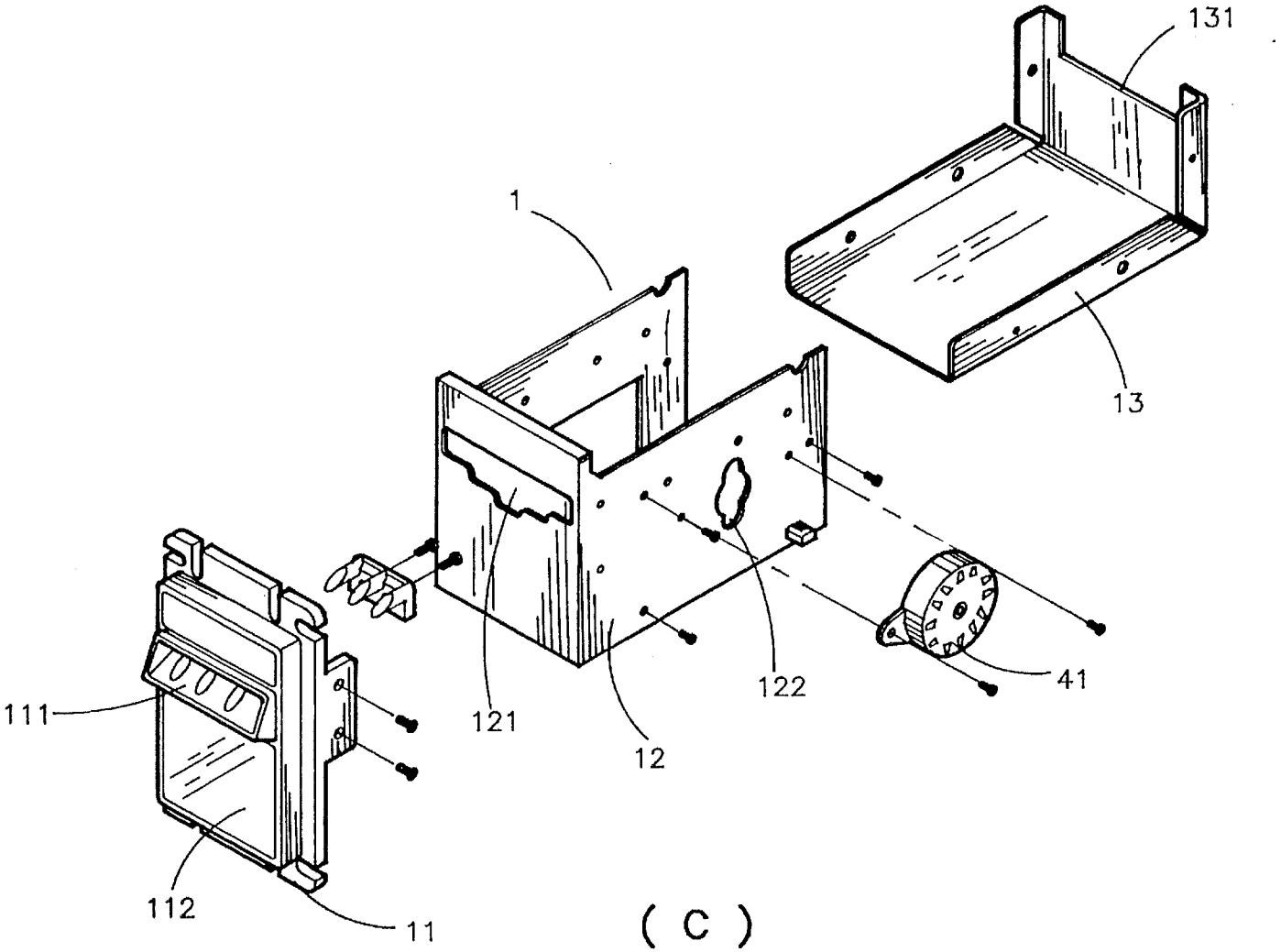
Figure 3:
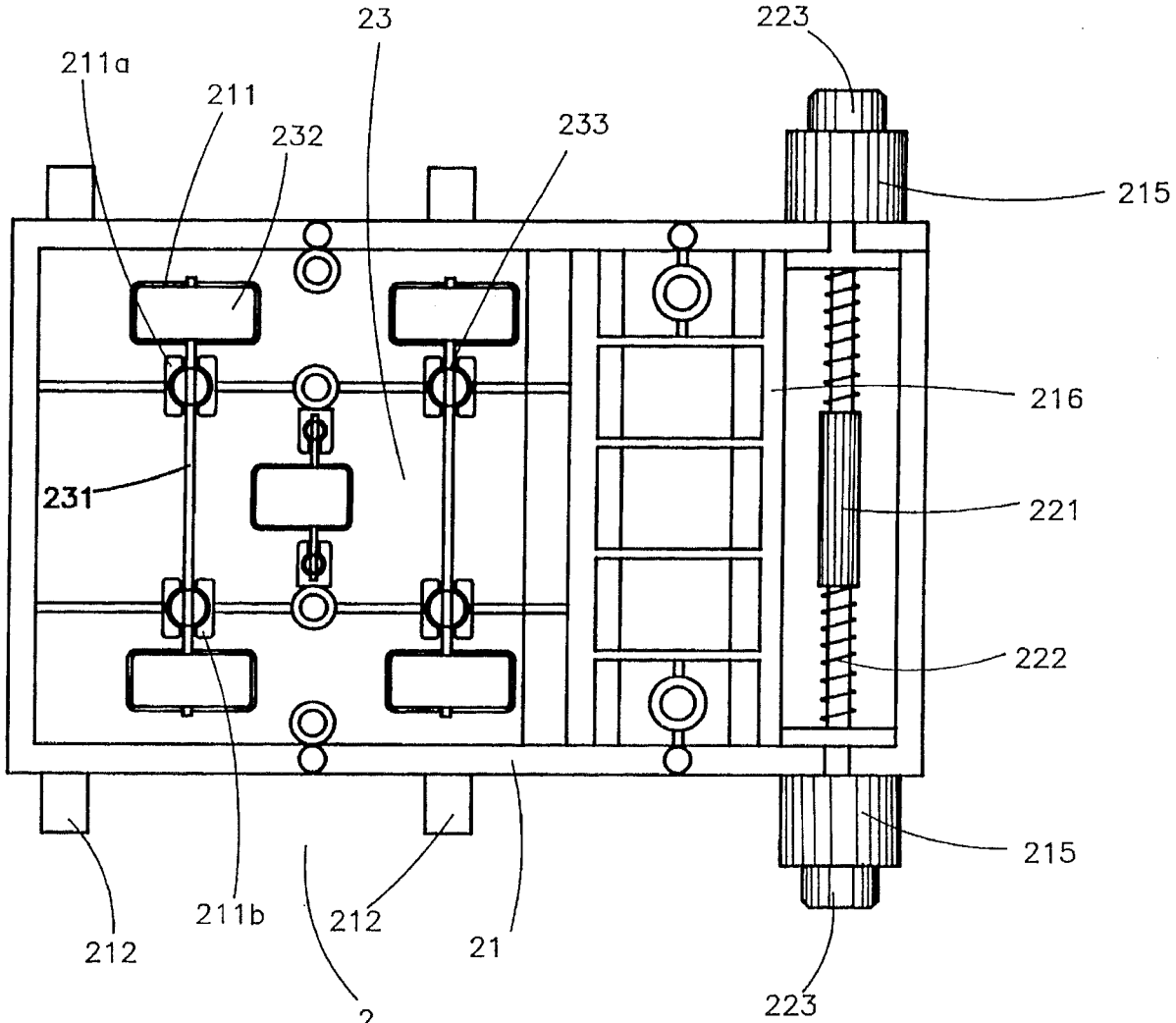
FIG. 3 is a top view of the upper mainframe shown in FIG. 2A.

Referring to FIGS. 2A, 2B, and 2C, a paper money recognition and transmission system for a vending machine in accordance with the present invention is generally comprised of a housing 1, an upper mainframe 2, a lower mainframe 3, a transmission unit 4, and a paper money recognition circuit 5.

The housing 1 comprises a front panel 11, a base frame 12, a bottom shell 13, and a top cover 14. The base frame 12, bottom shell 13 and top cover 14 are fixedly mounted around the upper and lower frame units 2 and 3 to hold the upper and lower frame units 2 and 3 on the inside. The front panel 11 is fixedly fastened to the base frame 12 at the front, having a transverse money slot 111 for the insertion of paper money and symmetrical mounting holes 112 respectively fastened to respective mounting holes 123 on the base frame 12 by screws. The base frame 12 comprises a transverse front slot 121 aligned with the transverse money slot 111 for passing paper money, and a side opening 122 for passing the shaft of a step motor (this will be explained further). The bottom shell 13 has a back opening 131, through which inserted paper money is guided to a money box.

The upper mainframe 2 comprises a casing 21 having a plurality of wheel holders 211, a plurality of roller sets 23, which comprise each a shaft 231 and two rollers 232 at two opposite ends of the shaft 231, a cover board 24 fastened to upright posts 2112 on the casing 21 and covered over the roller sets 23, a plurality of springs 233 stopped between the cover board 24 and the shafts 231 of the roller sets 23, and a locking device 22 mounted in rear barrels 215 on the casing 21 for locking the connection between the upper mainframe 2 and the lower mainframe 3. The casing 21 of the upper mainframe 2 further comprises a transverse groove 213 at the bottom near the rear end, two opposite pairs of pins 212 symmetrically perpendicularly raised from two opposite sides, retaining holes 214. The locking device 22 is installed in a receiving chamber 216 in the casing 21, comprising a stepped axle 221, two compression springs 222 mounted around two opposite ends of the stepped axle 221, and two retainers 223 respectively mounted on two opposite ends of the stepped axle 221 and supported on the compression springs 222. The retainers 223 have a respective hook 223*a* for hooking the lower mainframe 3.

The lower mainframe 3 comprises an open chamber 31, a magnetic head mounting portion 311 in the middle of the open chamber 31, a plurality of sensor holes 312 around the magnetic head mounting portion 311, two elongated belt slots 313 bilaterally disposed in the longitudinal direction, a convex portion 315 raised from the bottom wall of the open chamber 31, transverse slot 314 transversely disposed along the rear side behind the convex portion 315, two opposite upright frames 32 disposed at two opposite lateral sides, two hooks 321 respectively projected from the upright frames 32 at the front, two sliding ways 321*a* respectively formed on the upright frames 32 and extended from the hooks 321 at the bottom for guiding the front pair of the pins 212 into position to respectively hook up with the hooks 321, two retaining notches 322 on the upright frames 32 for engagement with the rear pair of the pins 212, two opposite locating notches 323 and two opposite locating square holes 324 on the upright frames 32 near the respective rear top corners, a plurality of bottom rods 329 respectively fitted into respective mounting holes 329*a*1 on a mounting plate 329*a*, a toothed rod 325, a mounting rod 326, a retaining holes 327 and 327*a*, and two opposite barrels 328.

The transmission unit 4 comprises a step motor 41, a belt transmission mechanism 42, a gear transmission mechanism 43, a plurality of caps 44, and two rubber rollers 45. The gear transmission mechanism 43 comprises a first gear wheel 431, a second gear wheel 432, and a third gear wheel 433. The belt transmission mechanism 42 comprises two transmission shafts 421 and 422, two pairs of belt pulleys 423 respectively mounted on the transmission shafts 421 by locating rings 425 at two opposite ends, and two transmission belts 424 bilaterally mounted around the belt pulleys 423. Sockets 441 and 442 are respectively mounted on the transmission shafts 421 and 422 at two opposite ends. The socket 442 has a through hole 442*a* through which one end of the transmission shaft 422 is inserted into the hole 431*a* on the first gear wheel 431 of the gear transmission mechanism 43. The step motor 41 has a pinion 411 fixedly mounted around the output shaft thereof and turned to rotate the gear wheels 431, 432 and 433 of the gear transmission mechanism 43. The second and third gear wheels 432 and 433 are respectively mounted on the shafts 451 of the rubber rollers 45 at one side. The shafts 451 of the rubber rollers 45 and the transmission shafts 421 and 422 are respectively transversely fastened to the locating notches 323, retaining holes 327 and 327*a* and barrels 328 on the lower mainframe 3 at the bottom by the sockets 441 and 442 and the caps 44.

The paper money recognition circuit 5 detects and recognizes inserted paper money and drives the step motor 41 to turn the transmission unit 4 when an inserted paper money is recognized. It also controls a delay of time to let an inserted paper money to be moved into position for recognition. The paper money recognition circuit 5 comprises a first sensor 51 and a second sensor 52 symmetrically disposed at two opposite sides for paper money detection and recognition, a third sensor 53 disposed in the middle at the front for detecting the revolving speed of the rubber rollers, and a magnetic head 54 disposed within the sensors 51,52 and 53 and controlled to read the pattern of the inserted paper money for comparison with the pre-stored reference data in the CPU on the paper money recognition circuit (see FIG. 7) so as to check the value of the inserted paper money. The paper money recognition circuit 5 further comprises three light emitting diodes (LED) 55 for illumination. The third sensor 53 is programmably controlled to turn the step motor 41 reversely, permitting the recognized paper money to be delivered to the money box. When the recognized paper money is delivered forwards, the light emitting diodes 55 are triggered to flash once and then turned off immediately. If the recognized paper money is pulled back by an outside object before it reaches the convex portion 315 and the rubber rollers 45, the second sensor 52 detects the reverse movement of the recognized paper money and produces a signal to stop the transmission unit from working. If the recognized paper money is jammed in the open chamber 31, the three light emitting diodes 55 will be turned on to give light constantly until the trouble is solved.

Figure 4:
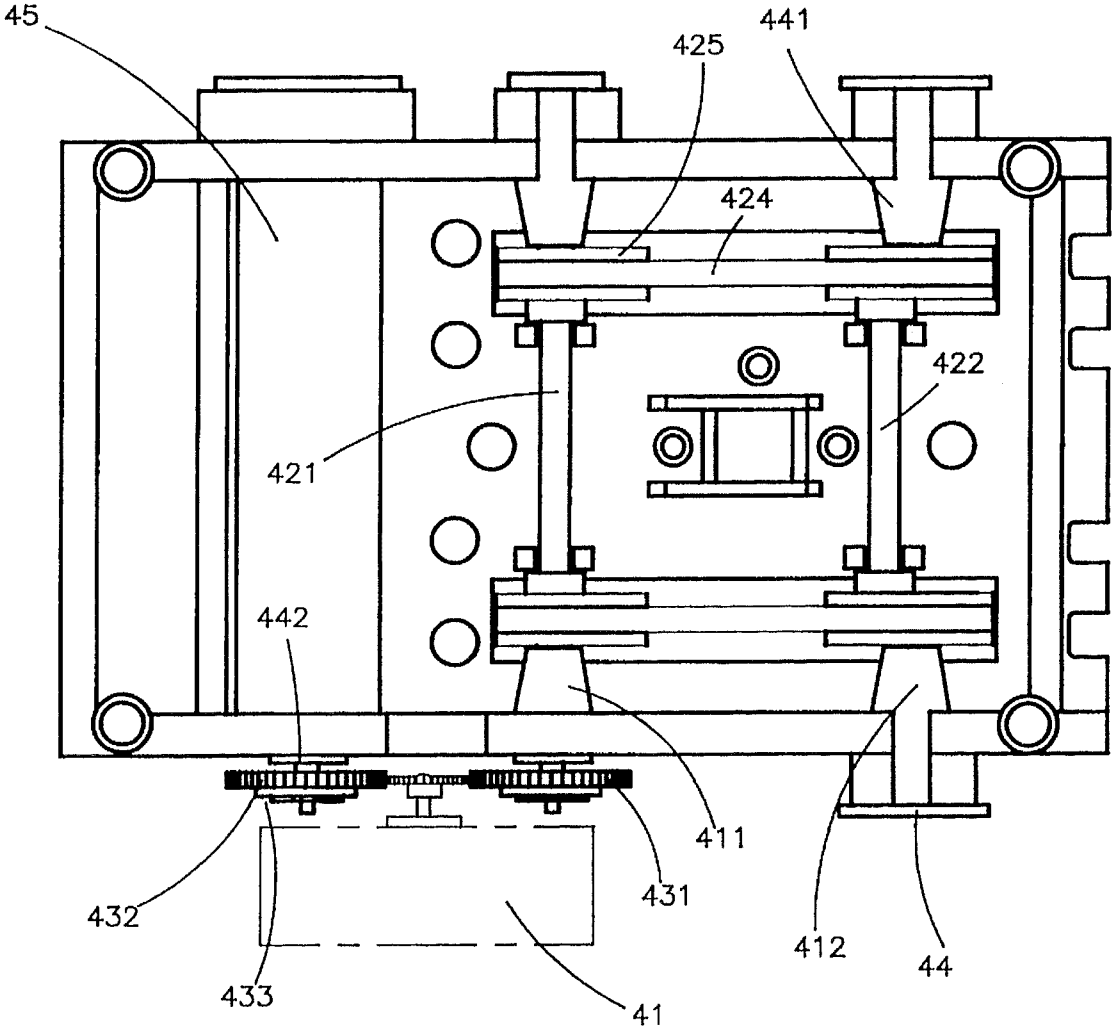
FIG. 4 is a bottom view of the lower mainframe and the gear transmission mechanism shown in FIG. 2B.

Referring to FIG. 4, the transmission unit 4 is mounted on the lower mainframe 3. The transmission shafts 421 and 422 are transversely mounted on the lower mainframe 3 at the bottom. The belt pulleys 423 are respectively mounted on the transmission shafts 421 at two opposite ends retained in place by the locating rings 425 and the sockets 441 and 442. The transmission belts 424 are mounted around the belt pulleys 423. The gear wheel 431 of the gear transmission mechanism 43 is coupled to the transmission shaft 422. When the step motor 41 is operated, the pinion is turned to move the gear transmission mechanism 43 and the rubber rollers 45 so that an inserted paper money is carried forwards and further delivered by the rubber rollers 45 into the money box (see FIG. 7).

Figure 5:
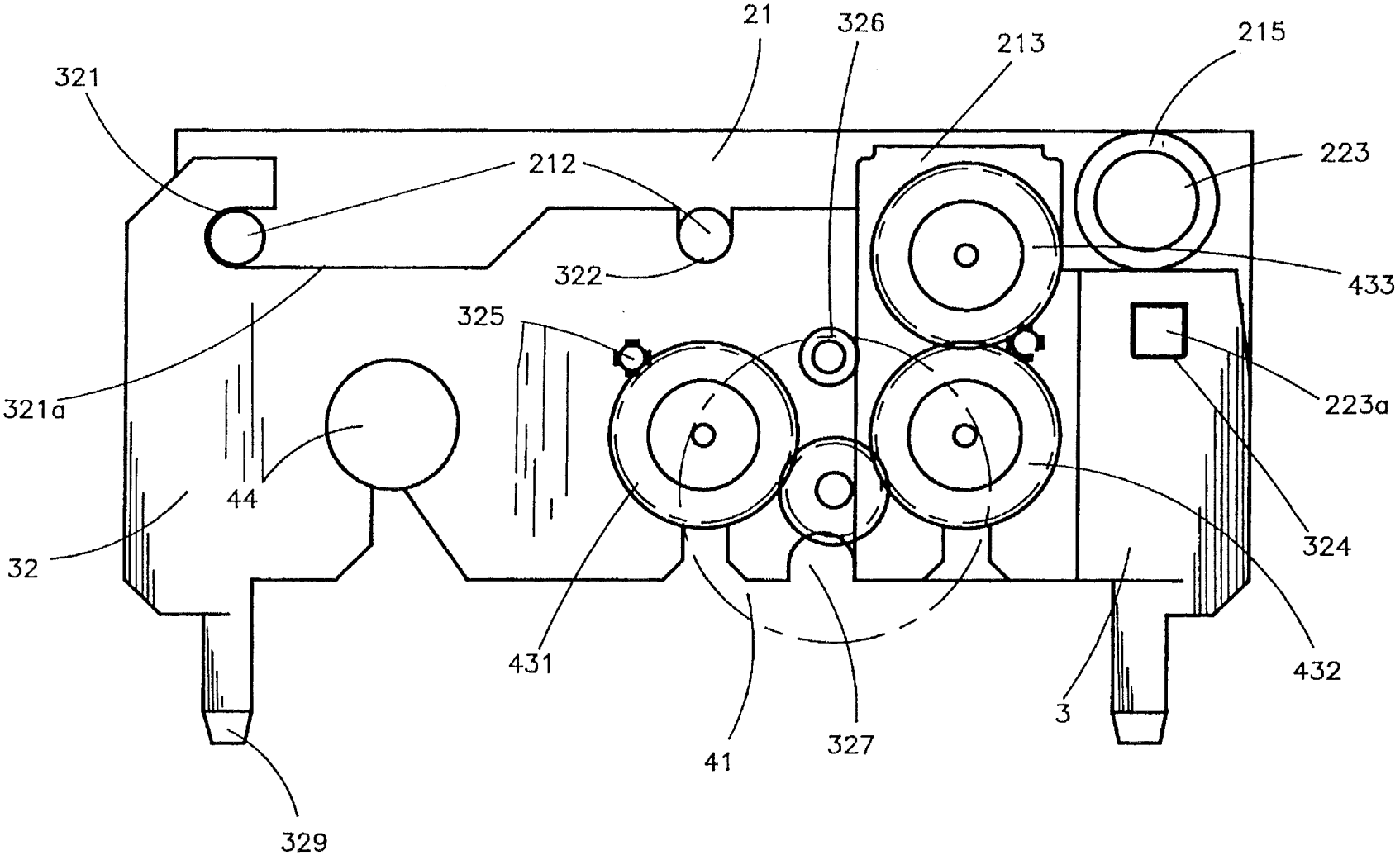
FIG. 5 shows the transmission operation of the gear transmission mechanism shown in FIG. 2B.
Figure 8:
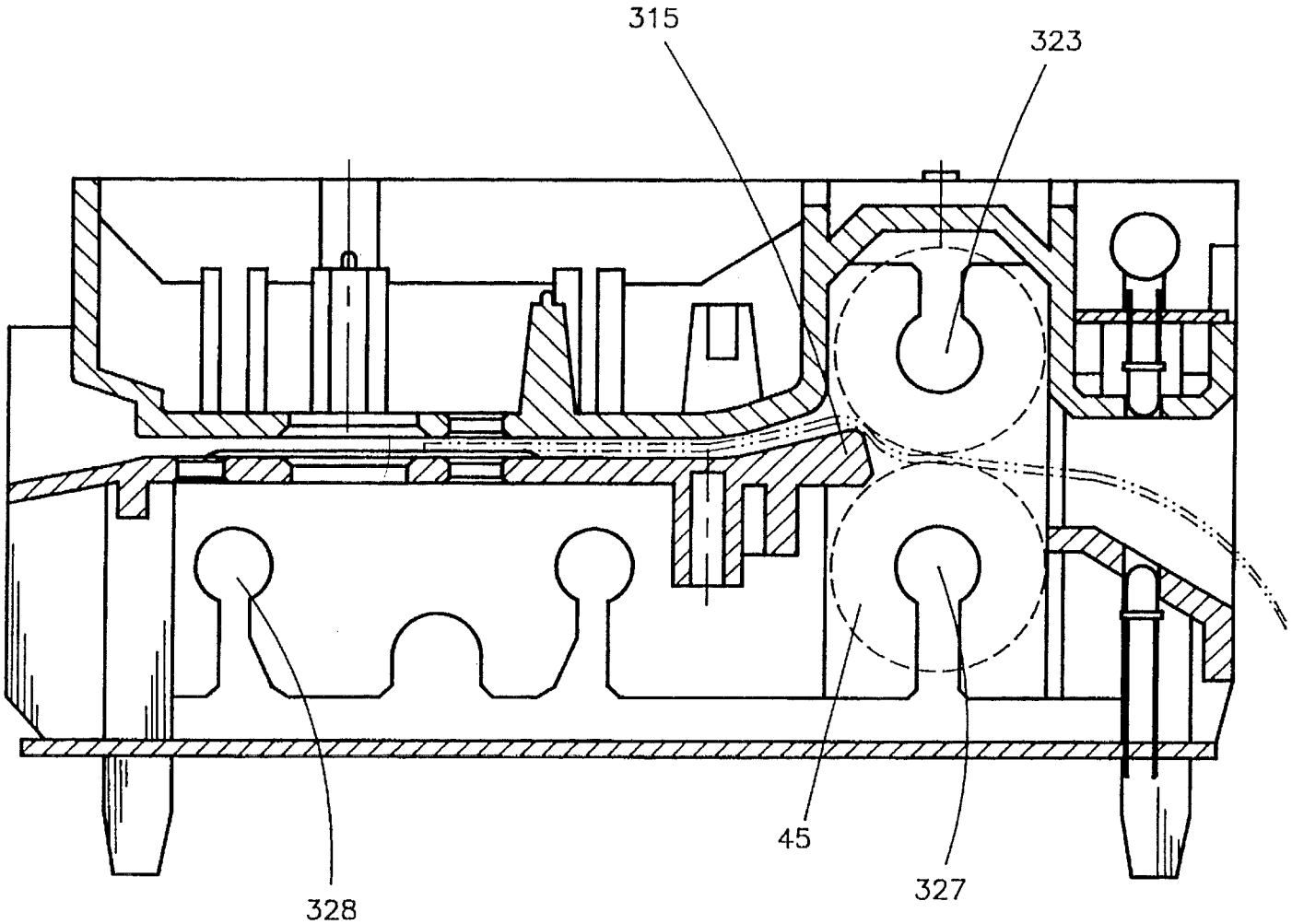
FIG. 8 is a schematic drawing showing the position of the convex portion in the open chamber of the lower mainframe relative to the positions of the rubber rollers according to the present invention.

Referring to FIGS. 5 and 8, when the pinion 411 is turned by the step motor 41 to move the gear wheel 431, the gear wheel 433 is then turned by the gear wheel 431 via the gear wheel 432, causing the rubber rollers 45 rotated, and therefore the recognized paper money is moved over the convex portion 315 and sent to the money box by the rubber rollers 45. The arrangement of the convex portion 315 prevents the recognized paper money from being pulled backwards when the recognized paper money is delivered through the gap between the rubber rollers 45.

Figure 6:
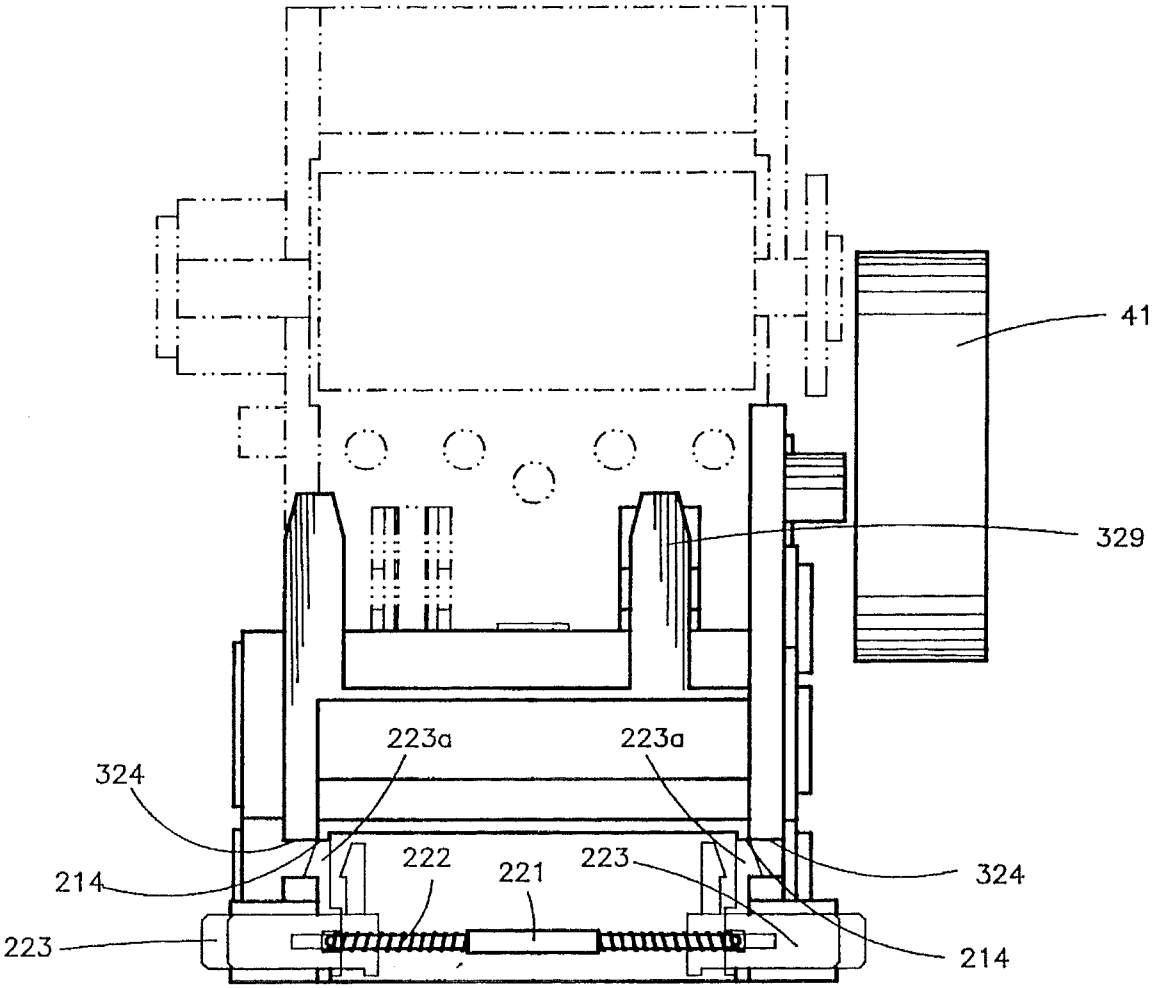
FIG. 6 is a top view showing the connection between the casing of the upper mainframe and the lower mainframe according to the present invention.
Figure 7:
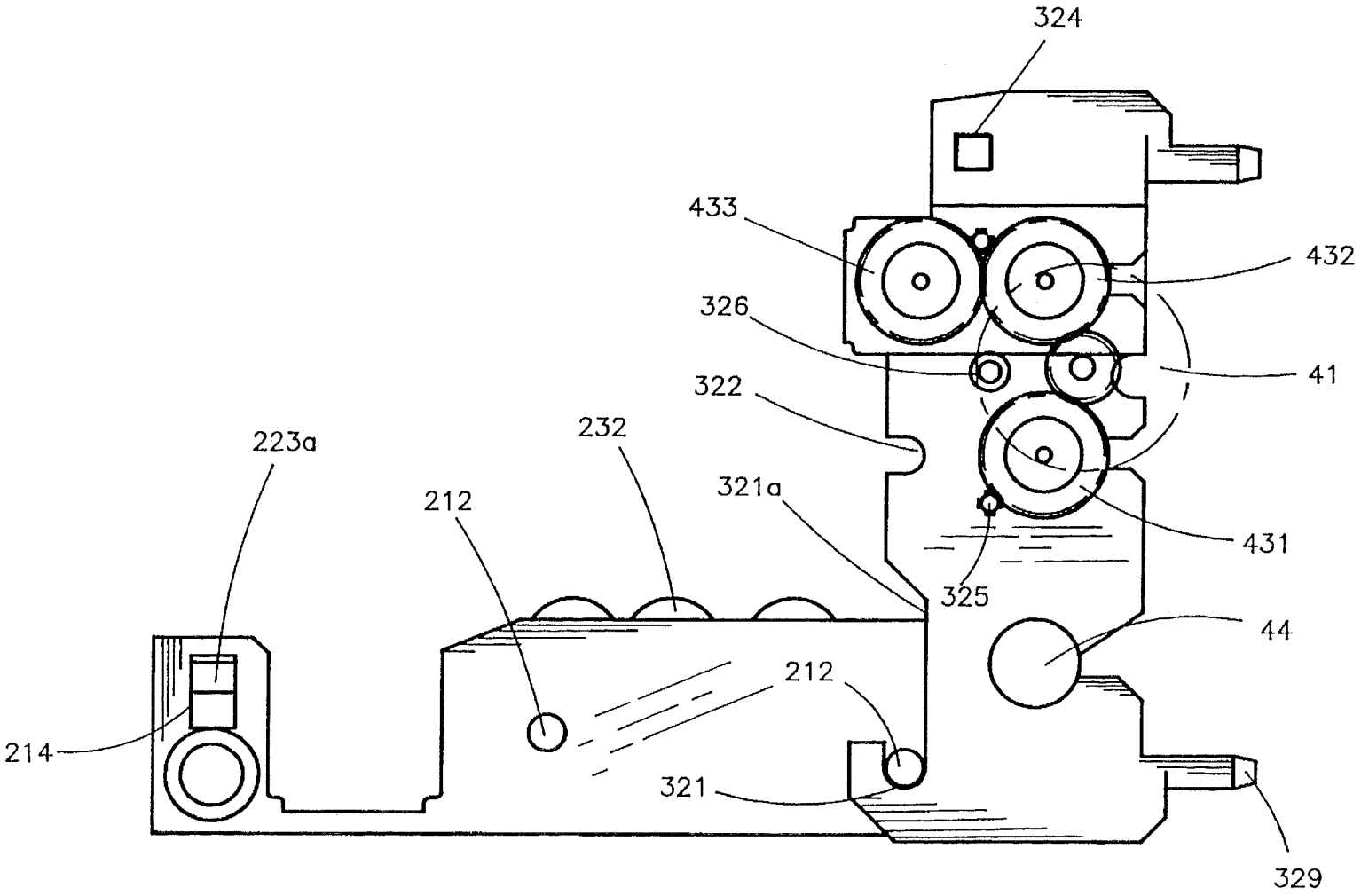
FIG. 7 is a side view showing the casing of the upper mainframe unlocked from the lower mainframe according to the present invention.

Referring to FIGS. 6 and 7, when the retainers 223 are respectively pushed inwards to compress the compression springs 222, the hooks 223*a* of the retainers 223 are respectively released from the retaining holes 214 on the casing 21 and locating square holes 324 on the lower mainframe 3, and therefore the lower mainframe 3 is detached from the casing 21 of the upper mainframe 2.

While only one embodiment of the present invention has been shown and described, it will be understood that various modifications and changes could be made without departing from the spirit and scope of the invention.

What is claimed is:

1. A paper money recognition and transmission system for a vending machine comprising: a housing having a paper money slot for the insertion of paper money by consumers and a paper money outlet; an upper mainframe disposed inside said housing, said upper mainframe comprising a casing having a plurality of wheel holders, a plurality of roller sets respectively mounted on said wheel holders and turned to deliver inserted paper money, a cover board covered over said roller sets, a plurality of springs stopped between said cover board and said roller sets; a locking device; a lower mainframe disposed inside said housing and connected to the casing of said upper mainframe and locked in position by said locking device; a transmission unit mounted on said lower mainframe and operated to transmit inserted paper money to a money box, said transmission unit comprising a step motor which drives a gear transmission mechanism which in turn cooperates with a belt transmission mechanism, two rubber rollers and a plurality of caps; and a paper money recognition circuit controlled to recognize inserted paper money;

wherein said said lower mainframe comprises a convex portion disposed in parallel with said rubber rollers for guiding inserted paper money in between said rubber rollers to prevent inserted paper money from being pulled backwards; and said paper money recognition circuit comprises three light emitting diodes, said light emitting diodes being triggered to flash once and then turned off immediately when inserted paper money is delivered through said rubber rollers, said light emitting diodes being turned on to give light constantly when inserted paper money is jammed.

* * * * *